US008897666B2

(12) United States Patent
Sugino et al.

(10) Patent No.: US 8,897,666 B2
(45) Date of Patent: Nov. 25, 2014

(54) FIXING DEVICE AND IMAGE FORMING APPARATUS

(75) Inventors: Mizuki Sugino, Kanagawa (JP); Satoshi Nakamura, Kanagawa (JP); Haruhiko Nishida, Kanagawa (JP); Masataka Konishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 128 days.

(21) Appl. No.: 13/458,683

(22) Filed: Apr. 27, 2012

(65) Prior Publication Data

US 2013/0149000 A1 Jun. 13, 2013

(30) Foreign Application Priority Data

Dec. 9, 2011 (JP) ..... 2011-269620

(51) Int. Cl.
*G03G 15/20* (2006.01)

(52) U.S. Cl.
USPC ..... 399/92; 399/94; 399/327; 399/329

(58) Field of Classification Search
CPC G03G 15/2025; G03G 15/20; G03G 15/2075
USPC ..... 399/92, 94, 67, 320, 327, 328, 329
See application file for complete search history.

(56) References Cited

U.S. PATENT DOCUMENTS

| | | | | |
|---|---|---|---|---|
| 5,678,153 | A * | 10/1997 | Okamoto et al. | 399/327 |
| 2005/0008388 | A1* | 1/2005 | Karasawa | 399/92 |
| 2005/0180786 | A1* | 8/2005 | Yamada et al. | 399/327 |
| 2006/0093411 | A1* | 5/2006 | Watanabe et al. | 399/327 |
| 2011/0142480 | A1* | 6/2011 | Miyata et al. | 399/92 |
| 2011/0222923 | A1* | 9/2011 | Watanabe | 399/327 X |
| 2011/0236083 | A1* | 9/2011 | Shimizu et al. | 399/327 |
| 2012/0195653 | A1* | 8/2012 | Sasaki | 399/327 |
| 2012/0224869 | A1* | 9/2012 | Yamada | 399/328 X |

FOREIGN PATENT DOCUMENTS

JP 2011-123198 A 6/2011

* cited by examiner

*Primary Examiner* — Sophia S Chen
(74) *Attorney, Agent, or Firm* — Sughrue Mion, PLLC

(57) ABSTRACT

A fixing device includes a rotatable pressure member; a heating member that is provided so as to oppose the pressure member, and that includes a heat source; a fixing member that fixes an image to a recording medium as a result of transporting the recording medium while the recording medium is nipped at a nip when the fixing member is pressed by the pressure member, the image being formed of toner including a separating agent; a cooling unit that cools the pressure member at a location that is situated downstream of the nip; a removing roller that, while being driven and rotated by the pressure member, removes the separating agent from the pressure member, the separating agent being transferred from the fixing member; and a removing member that contacts the removing roller and removes the separating agent adhered to the removing roller from the removing roller.

5 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-269620 filed Dec. 9, 2011.

BACKGROUND

(i) Technical Field

The present invention relates to a fixing device and an image forming apparatus.

SUMMARY

According to an aspect of the invention, there is provided a fixing device including a rotatable pressure member; a heating member that is provided so as to oppose the pressure member, and that includes a heat source; a fixing member that is contacted by the heating member, the fixing member fixing an image to a recording medium as a result of transporting the recording medium while the recording medium is nipped at a nip when the fixing member is pressed by the pressure member, the image being formed of toner including a separating agent, the nip being formed between the fixing member and the pressure member; a cooling unit that cools the pressure member at a location that is situated downstream of the nip; a removing roller that, while being driven and rotated by the pressure member, removes the separating agent from the pressure member, the separating agent being transferred from the fixing member; and a removing member that contacts the removing roller and removes the separating agent adhered to the removing roller from the removing roller.

BRIEF DESCRIPTION OF THE DRAWINGS

Exemplary embodiments of the present invention will be described in detail based on the following figures, wherein.

DETAILED DESCRIPTION

A fixing device and an image forming apparatus according to exemplary embodiments of the present invention will hereunder be described with reference to the attached drawings. For the sake of explanatory convenience, an arrow UP denotes an upward direction and an arrow RI denotes a rightward direction. In each figure, when such arrows are shown, top, bottom, right, left, front, and back will be expressed in accordance with the directions indicated by these arrows. In the description below, upstream and downstream in the direction of transport of a recording medium (serving as a sheet member) may simply be referred to as "upstream" and "downstream," respectively.

Image Forming Apparatus

Figure 1:
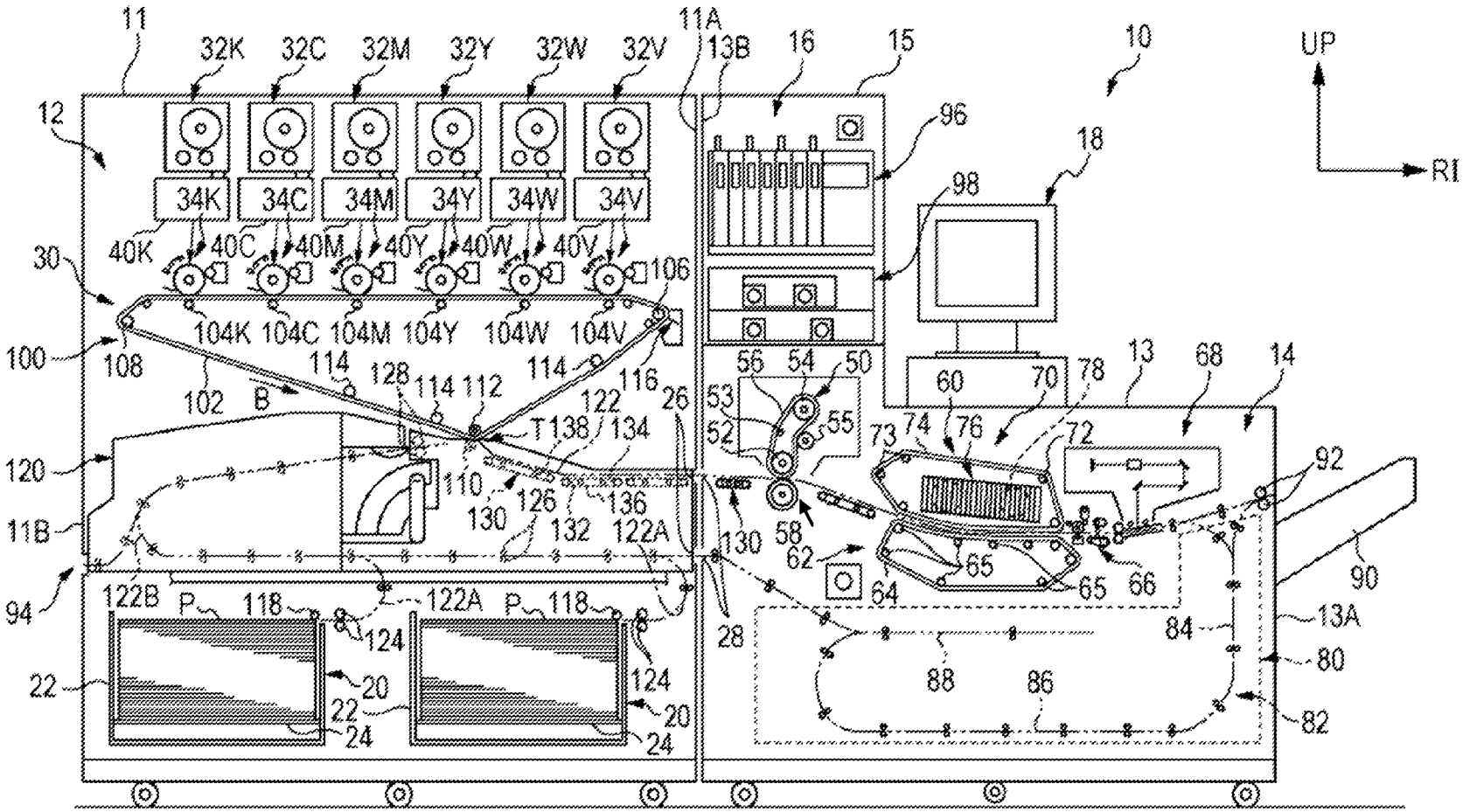
FIG. 1 illustrates a structure of an image forming apparatus according to an exemplary embodiment of the present invention.

As shown in FIG. 1, an image forming apparatus 10 according to the exemplary embodiment of the present invention includes a first processing section 12 and a second processing section 14, which are integrally connected to each other (so as to be capable of transfer pieces of recording paper P) in a left-right lateral direction (horizontal direction). The first processing section 12 performs operations up to the operation for second-transferring developer images (hereunder referred to as "toner images") to a piece of recording paper P (serving as an exemplary recording medium) and transporting the recording paper P. The second processing section 14 performs an operation for fixing the toner images to the recording paper P transported from the first processing section 12 and operations subsequent to this fixing operation.

The first processing section 12 is built in a first housing 11. The second processing section 14 is built in a second housing 13 that is mountable to and removable from the first housing 11. A third housing 15 having a controller 16 built therein is disposed on the second housing 13 that is adjacent to the first housing 11. A display device 18 is disposed on the second housing 13 that is disposed beside (that is, downstream of) the third housing 15.

The first processing section 12 includes sheet feeding sections 20 that hold pieces of recording paper P, a transporting section 120 that transports the pieces of recording paper P, a transfer section 100 (serving as an exemplary transfer device) that transfers toner images to the pieces of recording paper P, and an image forming section 30 where the toner images that are first-transferred to the transfer section 100 are formed. More specifically, first, two sheet feeding cassettes 22 that hold the pieces of recording paper P are disposed at a lower portion in the first housing 11 so as to be provided side by side in the left-right lateral direction.

The sheet feeding cassettes 22 are each drawable towards the front from the inside of the first housing 11. When the sheet feeding cassettes 22 are drawn out from the inside of the first housing 11, bottom plates 24, provided in the respective sheet feeding cassettes 22, are lowered. By placing pieces of recording paper P on the bottom plates 24, the sheet feeding cassettes 22 are capable of being replenished with the pieces of recording paper P. When the sheet feeding cassettes 22 are mounted in the first housing 11, the respective bottom plates 24 are raised.

The transporting section 120 is disposed above the sheet feeding cassettes 22. The transfer section 100 is disposed above the transporting section 120. The image forming section 30 is disposed above the transfer section 100. The image forming section 30, the transfer section 100, and the transporting section 120 will be described later. Openings 26 for transporting the pieces of recording paper P out of the first housing 11 from an upper side and for transporting the pieces of recording paper P into the first housing 11 from a lower side are formed in a right wall surface 11A of the first housing 11 opposing the second housing 13.

The second processing section 14 includes a fixing section 50, a cooling section 60, and a reversing section 80. The fixing section 50 serving as an exemplary fixing device fixes toner images second-transferred to a piece of recording paper P by the transfer section 100 to the piece of recording paper P. The cooling section 60 cools the recording paper P to which the toner images are fixed by the fixing section 50. During duplex printing, the reversing section 80 is used for reversing the recording paper P and transporting the recording paper P again to the first processing section 12.

That is, openings 28 for transporting pieces of recording paper P into the second housing 13 from the upper side and for transporting the pieces of recording paper P out of the second housing 13 from the lower side are formed in a left wall surface 13B of the second housing 13 opposing the right wall surface 11A of the first housing 11. The openings 28 oppose the openings 26. The fixing section 50 is disposed so that it is capable of fixing toner images to a piece of recording paper P transported through the upper opening 28. The fixing section 50 will be described in detail below.

The cooling section 60 is disposed beside (that is, downstream of) the fixing section 50. The cooling section 60 is provided with an absorbing device 70 that contacts a piece of recording paper P and that absorbs its heat, and a pushing device 62 that pushes the piece of recording paper P that is being transported against the absorbing device 70. The absorbing device 70 is disposed at an upper side of the cooling section 60, and the pushing device 62 is disposed at a lower side of the cooling section 60, with a transport path 122 (described later) being disposed therebetween.

The absorbing device 70 includes an endless absorbing belt 74 that is wound upon a driving roller 72, which transmits a driving force, and tension rollers 73. The absorbing device 70 also includes a heat sink 76 disposed at an inner side of the absorbing belt 74. The heat sink 76 contacts the absorbing belt 74 in a planar manner, and causes the heat absorbed by the absorbing belt 74 to be dissipated. Two induced draft fans 78 that take away the heat from the heat sink 76 and that exhaust the heat to the outside are provided side by side at a rear-wall-portion side (back side) of the second housing 13.

The pushing device 62 includes an endless pushing belt 64 that contacts a piece of recording paper P that is being transported, and that pushes the piece of recording paper P against the absorbing device 70. The pushing belt 64 is tightly stretched around and rotatably supported by tension rollers 65. By the cooling section 60 having such a structure, the piece of recording paper P that is transported from the fixing section 50 is cooled.

A decurling section 66 that decurls curling of recording paper P (that straightens the recording paper P) is disposed beside (that is, downstream of) the cooling section 60. An inline sensor 68 is disposed beside (that is, downstream of) the decurling section 66. The inline sensor 68 optically detects, for example, erroneous positions, defects, and improper densities of toner images fixed to the recording paper P.

Discharge rollers 92 are provided beside (that is, downstream of) the inline sensor 68. The discharge rollers 92 discharge recording paper P on whose one side an image is formed to a discharge section (discharge tray) 90 mounted to a right wall surface 13A of the second housing 13. When one-side printing is performed, the discharge rollers 92 discharge the recording paper P to the discharge section 90.

The reversing section 80 is disposed below the fixing section 50, the cooling section 60, the decurling section 66, and the inline sensor 68. That is, when forming images on both surfaces of recording paper P, the recording paper P sent out from the inline sensor 68 is transported to the reversing section 80. More specifically, the recording paper P is guided to a reversing path 82 of the reversing section 80 by a switching member (not shown).

The reversing path 82 includes, in the second processing section 14, a branch path 84 that branches from the transport path 122 (described later), a sheet transport path 86 that allows the recording paper P transported along the branch path 84 to be transported towards the first processing section 12, and a reversing path 88 that allows the recording paper P transported along the sheet transport path 86 to turn back in an opposite direction and to be redirected, so that the front and back of the recording paper P are reversed.

By this structure, the recording paper P that is redirected by the reversing path 88 is transported into the first processing section 12 through the lower opening 28 and the lower opening 26, is further transported to the transport path 122 in the transporting section 120, and is sent again to a transfer point T that is a nip between a backup roller 112 and a second transfer roller 110 described below.

A supply section 94 is provided in a left wall surface 11B of the first housing 11 for making it possible to supply recording paper P from a high-capacity sheet feeding cassette (not shown) that is adjacent to and externally mounted to the left wall surface 11B. The controller 16 includes an image signal processing section 96 and a power supply section 98. The image signal processing section 96 processes image data that is sent from, for example, a computer (not shown). The power supply section 98 supplies electrical power to each portion.

Next, the image forming section 30 will be described. In the image forming apparatus 10 according to the exemplary embodiment, toner cartridges 32V, 32W, 32Y, 32M, 32C, and 32K that contain toner having a first special color (V), toner having a second special color (W), yellow (Y) toner, magenta (M) toner, cyan (C) toner, and black (K) toner, respectively, are replaceably provided side by side in a left-right lateral direction (horizontal direction). Accordingly, the image forming apparatus 10 is capable of forming a full-color image or a monochrome image.

The first and second special colors are appropriately selected from special colors (including transparent colors) which are not yellow, magenta, cyan, and black. In the following description, when V, W, Y, M, C, or K needs to be indicated, V, W, Y, M, C, or K will be added in front of the reference numeral, whereas, when V, W, Y, M, C, or K does not need to be indicated, V, W, Y, M, C, or K will not be added in front of the reference numeral.

Six image forming units 34 corresponding to the toners of the corresponding colors are provided below the toner cartridges 32 so as to be disposed side by side in the left-right lateral direction (horizontal direction) in correspondence with the toner cartridges 32. Exposure units 40 are provided between the toner cartridges 32 and the corresponding image forming units 34.

The exposure units 40 provided in correspondence with the image forming units 34 receive pieces of image data processed by the image signal processing section 96, to perform modulation in semiconductor lasers (not shown) in accordance with pieces of coloring-material gradation data, so that exposure light L is emitted from each semiconductor laser in accordance with the corresponding coloring-material gradation data. More specifically, the surface of each photoconductor 36 (see FIG. 2; described later) is irradiated with the exposure light L for the corresponding color, so that an electrostatic latent image is formed on each photoconductor 36.

Figure 2:
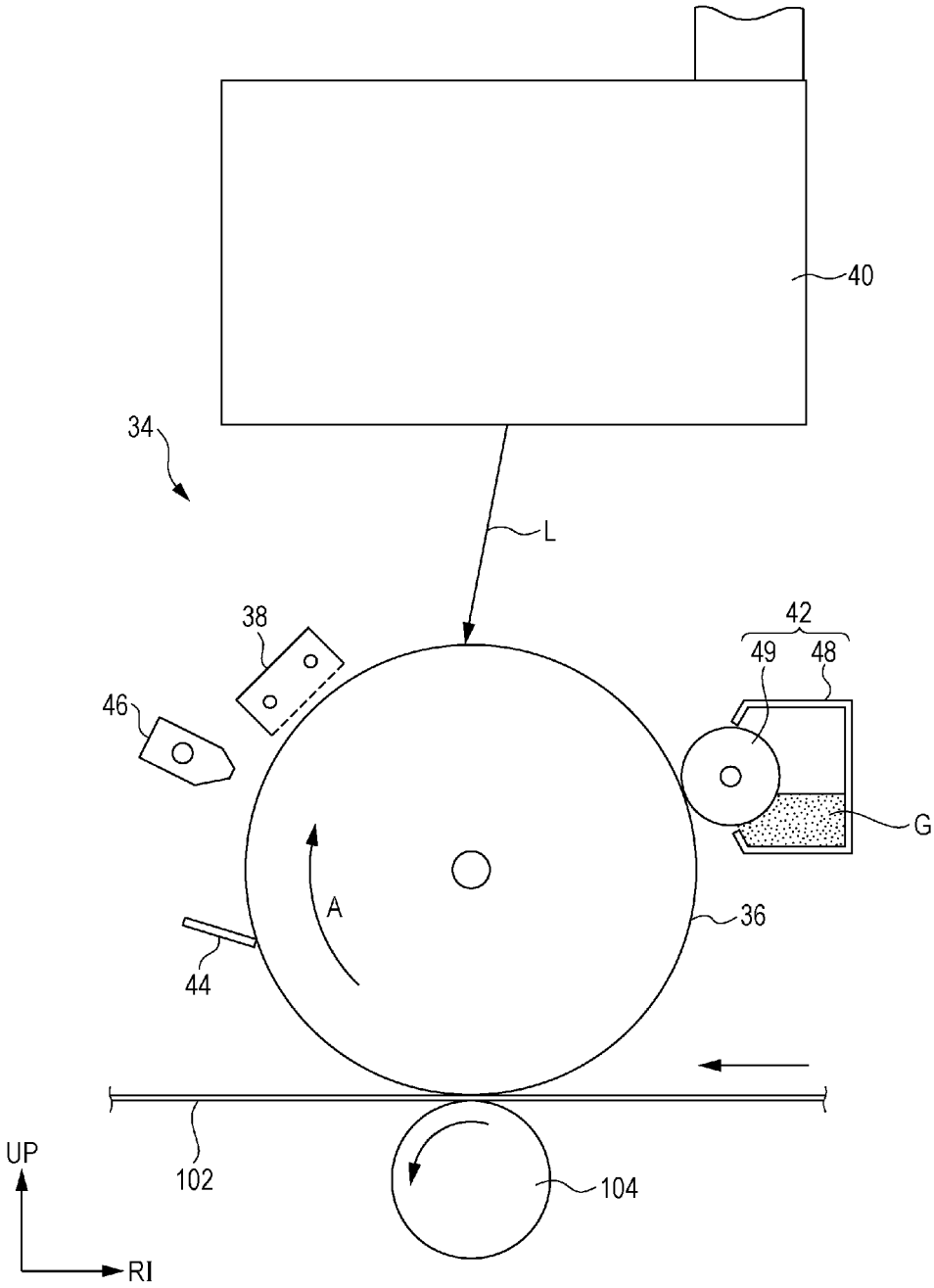
FIG. 2 illustrates a structure of an image forming unit shown in FIG. 1.

As shown in FIG. 2, each image forming unit 34 includes the corresponding photoconductor 36 (serving as an exemplary image holding member) that is rotationally driven in the direction of arrow A (that is, clockwise in FIG. 2). A scorotron charger 38 of a corona discharge type (a non-contact charging type), a developing device 42, a cleaning blade 44, and an erase lamp 46 are provided around the corresponding photoconductor 36. Each scorotron charger 38 is a charging device that uniformly charges its corresponding photoconductor 36. Each developing device 42 develops with the toner of the corresponding color an electrostatic latent image formed on the corresponding photoconductor 36 by the exposure light L emitted by the corresponding exposure unit 40. Each cleaning blade 44 serves as a cleaning device that cleans the surface of the corresponding photoconductor 36 after transfer. Each erase lamp 46 serves as an electricity removing device that removes electricity by irradiating with light the surface of its corresponding photoconductor 36 after the transfer.

The scorotron chargers 38, the developing devices 42, the cleaning blades 44, and the erase lamps 46 are disposed in that order from an upstream side to a downstream side in the direction of rotations of the photoconductors 36 so as to oppose the surfaces of the corresponding photoconductors 36.

The developing devices 42 are disposed beside (on the right side of) the corresponding image forming units 34. Each developing device 42 includes a developer containing member 48 and a development roller 49. Each developer containing member 48 is filled with a developer G including toner. Each development roller 49 moves the toner with which the corresponding developer containing member 48 is filled to the surface of the corresponding photoconductor 36. The developer containing members 48 are connected to the toner cartridges 32 (see FIG. 1) through toner supply paths (not shown), so that toner is supplied to the developer containing members 48 from the corresponding toner cartridges 32. The toner includes wax serving as an exemplary separating agent for increasing the separability of recording paper P from a fixing belt 56 (described later).

Next, the transfer section 100 will be described. As shown in FIG. 1, the transfer section 100 is provided below the image forming units 34. The transfer section 100 includes an endless intermediate transfer belt 102 and six first transfer rollers 104 serving first transfer members. The intermediate transfer belt 102 contacts each photoconductor 36. The first transfer rollers 104 are disposed at the inner side of the intermediate transfer belt 102, and transfer the toner images, formed on the corresponding photoconductors 36, to the intermediate transfer belt 102 so that they are superimposed upon each other.

With a certain tension, the intermediate transfer belt 102 is wound upon a driving roller 106, a tension applying roller 108, a backup roller 112, and tension rollers 114. The driving roller 106 is driven by a motor (not shown). The tension applying roller 108 adjusts the tension of the intermediate transfer belt 102. The backup roller 112 is disposed so as to oppose the second transfer roller 110 (described below). By the driving roller 106, the intermediate transfer belt 102 circulates in the direction of arrow B shown in FIG. 1 (that is, counterclockwise in FIG. 1).

More specifically, the first transfer rollers 104 are disposed so as to oppose the corresponding photoconductors 36 of the image forming units 34 with the intermediate transfer belt 102 being disposed therebetween. By a power supply unit (not shown), a transfer bias voltage having a polarity that is opposite to a toner polarity is applied to each first transfer roller 104. By this structure, the toner images formed on the corresponding photoconductors 36 are transferred to the intermediate transfer belt 102.

A cleaning blade 116 whose end contacts the intermediate transfer belt 102 is provided opposite the driving roller 106 with the intermediate transfer belt 102 being disposed therebetween. The cleaning blade 116 removes, for example, residual toner or paper powder on the intermediate transfer belt 102 that circulates.

Next, the transporting section 120 in the first processing section 12 will be described. Each send-out roller 118 is provided above an end side (illustrated right side) of its corresponding sheet feeding cassette 22, and sends out recording paper P from the corresponding sheet feeding cassette 22 to the transport path 122. Each send-out roller 118 contacts a topmost piece of recording paper P placed on the corresponding bottom plate 24 that is raised.

A pair of separating rollers 124 that prevent double feeding of pieces of recording paper P are provided downstream of each send-out roller 118. Pairs of transport rollers 126 that transport the pieces of recording paper P downstream are provided downstream of the pairs of separating rollers 124.

The transport path 122 of the transporting section 120, provided between the sheet feeding sections 20 (that is, the sheet feeding cassettes 22) and the transfer section 100 (that is, the intermediate transfer belt 102), causes a piece of recording paper P sent out from the sheet feeding cassette 22 to turn around in a leftward direction in FIG. 1 at a first turn around portion 122A, and to further turn around in a rightward direction in FIG. 1 at a second turn around portion 122B, so that the piece of recording paper P is sent out towards the transfer point T that is the nip between the second transfer roller 110 and the backup roller 112.

An aligner (not shown) that corrects, for example, tilting of the recording paper P that is transported is provided between the second turn around portion 122B and the transfer point T. Aligning rollers 128 for adjusting a timing of movement of toner images on the intermediate transfer belt 102 and a timing of transportation of the recording paper P are provided between the aligner and the transfer point T.

By a power supply unit (not shown), a transfer bias voltage having a polarity that is opposite to a toner polarity is applied to the second transfer roller 110 serving as a second transfer member provided downstream of the aligning rollers 128. By this structure, toner images of corresponding colors that are transferred to the intermediate transfer belt 102 so as to be superimposed upon each other are second-transferred to a piece of recording paper P that is transported along the transport path 122. The supply section 94 merges with the second turn around portion 122B of the transport path 122.

Vacuum transport devices 130 are provided downstream of the transfer point T. The vacuum transport devices 130 transport pieces of recording paper P to which toner images are transferred towards the inside of the second processing section 14. Each vacuum transport device 130 includes a driving roller 132 that is rotationally driven, a driven roller 134 that is rotatably supported, and belt members 136 that are wound around the driving roller 132 and the driven roller 134.

Through holes (not shown) are formed over the entire surfaces of the belt members 136. An induced draft fan 138 that draws air into the belt members 136 from the through holes is disposed at a rear-wall-portion side (back side in FIG. 1) of the first housing 11.

By this structure, when a back surface of recording paper P on which toner images are not formed (a non-image surface) is attracted to each belt member 136, and each belt member 136 is rotated by rotationally driving the corresponding driving roller 132, the recording paper P is further transported downstream, that is, to a vacuum transport device 130 of the second processing section 14.

The structure of the vacuum transport device 130 of the second processing section 14 is the same as the structure of each vacuum transport device 130 of the first processing section 12. A transport path 122 of the second processing section 14 is continuous with the transport path 122 of the transporting section 120 of the first processing section 12.

Next, an image forming process will be described.

Pieces of image data subjected to image processing at the image signal processing section 96 are converted into pieces of color-material gradation data of corresponding colors, and are successively output to the corresponding exposure units 40. In accordance with the pieces of color-material gradation data of the corresponding colors, the exposure units 40 emit corresponding exposure lights L and scan and expose the photoconductors 36 charged by the scorotron chargers 38, so that electrostatic latent images are formed.

The developing devices 42 make visible (that is, develop) the electrostatic latent images formed on the corresponding photoconductors 36 as toner images (developer images) of the corresponding colors, the first special color (V), the second special color (W), yellow (Y), magenta (M), cyan (C), and black (K).

The toner images of the corresponding colors formed on the photoconductors 36 of the corresponding image forming units 34V, 34W, 34Y, 34M, 34C, and 34K are successively transferred to the intermediate transfer belt 102 by the six first transfer rollers 104V, 104W, 104Y, 104M, 104C and 104K so as to be superimposed upon each other.

The second transfer roller 110 second-transfers the toner images of the corresponding colors, transferred to the intermediate transfer belt 102 so as to be superimposed upon each other, to recording paper P that is transported from the sheet feeding section 20 (the sheet feeding cassette 22). The recording paper P to which the toner images are transferred is transported to the fixing section 50 by the vacuum transport devices 130.

The fixing section 50 heats and presses the recording paper P transported to the fixing section 50, and fixes the toner images of the corresponding colors transferred to the recording paper P. Then, the recording paper P to which the toner images of the corresponding colors are fixed passes through the cooling section 60, and is, then, sent to a decurling section 66 to decurl the curled recording paper P. After an image defect or the like is detected by the inline sensor 68, the decurled recording paper P is discharged to the discharge section 90 by the discharge rollers 92.

When an image is to be formed on the back surface of the recording paper P on which an image is not formed (that is, when duplex printing is to be performed), the recording paper P is sent out to the reversing section 80 after passing the inline sensor 68. The recording paper P sent out to the reversing section 80 passes through and is reversed by the reversing path 82. Then, the recording paper P is sent again into the first processing section 12, so that toner images are formed on the back surface of the recording paper P by the above-described procedure.

Fixing Device

Next, the structure of the fixing section 50 will be described in detail.

Figure 3:
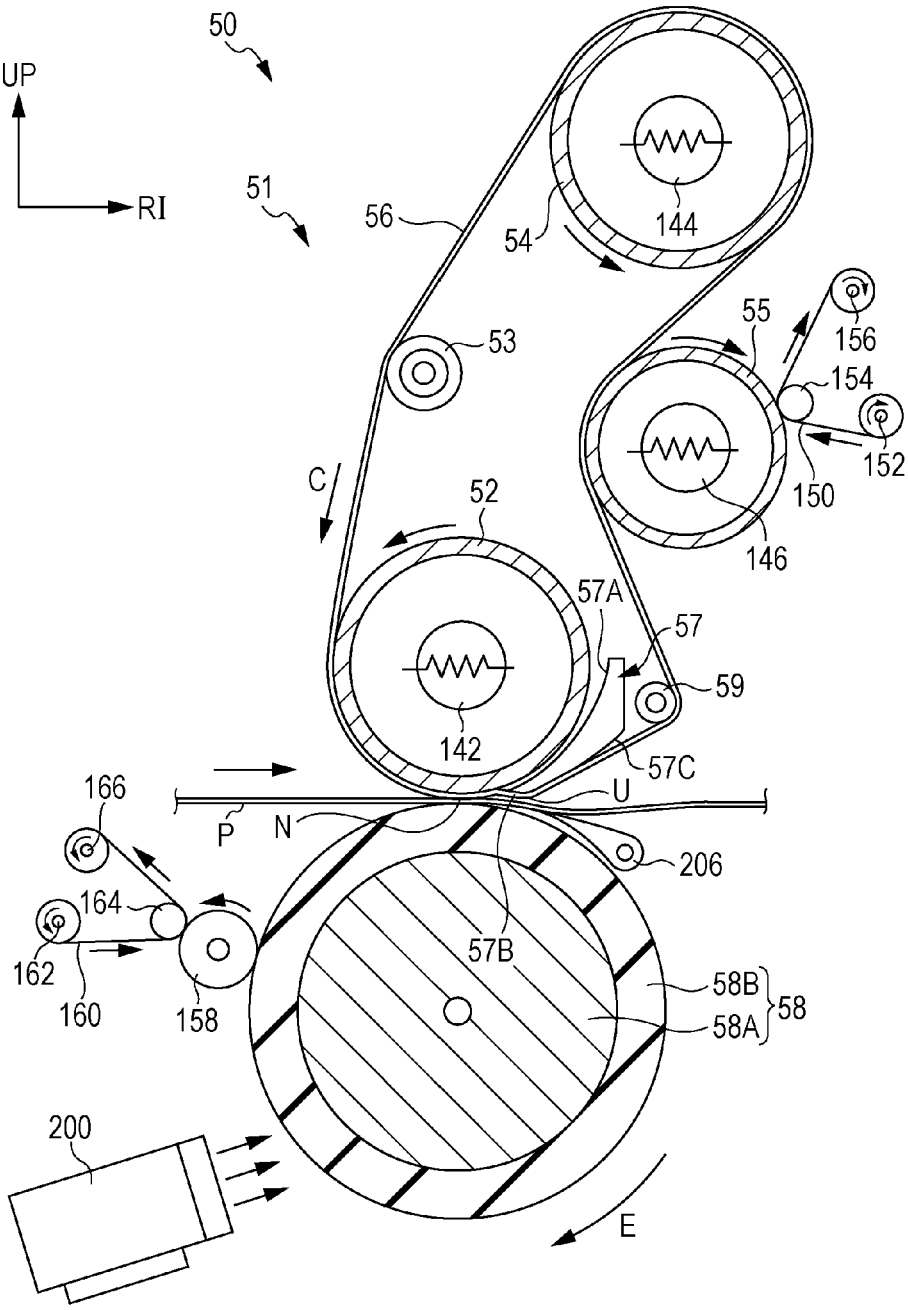
FIG. 3 illustrates a structure of a fixing device according to an exemplary embodiment of the present invention.

As shown in FIG. 3, the fixing section 50 includes a fixing belt 56, a heating module 51, and a pressure roller 58. The fixing belt 56 is an example of a fixing member. The heating module 51 is an example of a heating member upon which the fixing belt 56 is wound. The pressure roller 58 is an example of a pressure member disposed so as to oppose the heating module 51. The fixing belt 56 is an endless belt. A layer having separability and formed of fluorocarbon resin is formed at an outer peripheral surface of the fixing belt 56.

An area where the fixing belt 56 and the pressure roller 58 contact each other is a nip N. Recording paper P is transported while being nipped at the nip N formed between the fixing belt 56 and the pressure roller 58. During this time, the recording paper P is pressed and heated, so that toner images are fixed to the recording paper P.

The heating module 51 includes a heating roller 52, a supporting roller 54, a supporting roller 55, and an orientation correcting roller 53. The heating roller 52 is rotated by a rotational driving force transmitted from a driving motor (not shown) while the heating roller 52 tightly stretches the fixing belt 56 at a side of the pressure roller 58. The supporting roller 54 tightly stretches the fixing belt 56 from an inner side of the fixing belt 56 at a location that differs from that of the heating roller 52 (that is, at an upper position). The supporting roller 55 is disposed at an outer side of the fixing belt 56, and defines a circulation path. The orientation correcting roller 53 is disposed at the inner side of the fixing belt 56, and corrects the orientation of the fixing belt 56.

A separating pad 57 that separates the fixing belt 56 from the outer peripheral surface of the heating roller 52 is provided near the heating roller 52, provided at the inner side of the fixing belt 56, at an area that is downstream of the nip N. A supporting roller 59 that tightly stretches the fixing belt 56 is provided downstream of the separating pad 57 in a direction of transport of the fixing belt 56.

The heating roller 52 is a hard roller including a cylindrical aluminum cored bar and a protective layer formed around the surface of the cored bar. The protective layer prevents metal wear, and is, for example, a fluorocarbon resin film having a thickness of 200 μm. A halogen heater 142, serving as an exemplary heat source, is provided in the heating roller 52.

The supporting roller 54 is a cylindrical roller formed of aluminum. A halogen heater 144, serving as an exemplary heat source, is provided in the supporting roller 54. The halogen heater 144 heats the fixing belt 56 from an inner peripheral side of the fixing belt 56. Spring members (not shown) are disposed at respective end portions of the supporting roller 54. The spring members push outward the fixing belt 56 that is wound upon the end portions of the supporting roller 54.

The supporting roller 55 is a cylindrical roller formed of aluminum. A halogen heater 146, serving as an exemplary heat source, is provided in the supporting roller 55. The halogen heater 146 heats the fixing belt 56 from an outer peripheral side of the fixing belt 56.

That is, in the fixing section 50 according to the exemplary embodiment, the fixing belt 56 is heated by the heating roller 52, the supporting roller 54, and the supporting roller 55.

The orientation correcting roller 53 is a columnar roller formed of aluminum. An end portion position measuring mechanism (not shown) that measures the position of an end portion of the fixing belt 56 is disposed near the orientation correcting roller 53. An axial displacing mechanism (not shown) is disposed at the orientation correcting roller 53. The axial displacing mechanism displaces a contact position in a widthwise direction (axial direction) that is orthogonal to the direction of movement of the fixing belt 56 in accordance with a result of measurement of the end portion position measuring mechanism. The orientation correcting roller 53 is formed so as to control snaking of the fixing belt 56.

The separating pad 57 is a block member having a length that is in correspondence with an axial length of the heating roller 52, and is a rigid body formed of, for example, a ferrous metal or resin. The cross-sectional shape of the separating pad 57 has a substantially crescent shape including an inner surface 57A, a pushing surface 57B, and an outer surface 57C.

The inner surface 57A is curved and faces the heating roller 52. The pushing surface 57B pushes the fixing belt 56 towards the pressure roller 58. The outer surface 57C has a predetermined angle with respect to the pushing surface 57B and causes the fixing belt 56 to be curved.

A corner U is formed by the pushing surface 57B and the outer surface 57C of the separating pad 57. The corner U causes the fixing belt 56 that is pushed against the corner U by the pressure roller 58 to be curved. Accordingly, when the fixing belt 56 is curved, an edge of a piece of recording paper P is easily separated from the fixing belt 56 when the edge of the piece of recording paper P passes the corner U.

A cleaning web 150 that cleans the outer peripheral surface of the supporting roller 55 is disposed at the supporting roller 55. The cleaning web 150 is a long strip-like fiber member (such as a polyester member, a rayon member, or a nylon member). A large portion of the cleaning web 150 is previously wound upon a rotatable shaft section 152. The cleaning web 150 is wound upon an intermediate roller 154 that is disposed close to the supporting roller 55, and its end is secured to a shaft section 156. By rotationally driving the shaft section 156 by a motor (not shown), the cleaning web 150 is wound upon the shaft section 156 using the intermediate roller 154. That is, the cleaning web 150 cleans the outer peripheral surface of the supporting roller 55 by contacting the outer peripheral surface of the supporting roller 55 while the cleaning web 150 moves.

The pressure roller 58 includes a columnar roller 58A formed of aluminum and serving as a base member, and an elastic member 58B formed of silicone rubber and covering the base member. The elastic member 58B includes a layer having separability at its outer peripheral surface. The layer having separability has a film thickness of 100 μm and is formed of fluorocarbon resin. The pressure roller 58 is rotatably supported, and is pressed by the fixing belt 56, so that the pressure roller 58 is rotated in the direction of arrow E by the circulating movement of the fixing belt 56 in the direction of arrow C.

A separating claw 206 is disposed downstream of the nip N in the direction of rotation of the pressure roller 58 and near an upper portion of the pressure roller 58. The separating claw 206 assists in separating the recording paper P from the pressure roller 58. The separating claw 206 is disposed so that its end faces a slight gap between the separating claw 206 and the outer peripheral surface of the pressure roller 58.

A fan 200 serving as an exemplary cooling unit is provided downstream of the nip N of the pressure roller 58. The fan 200 cools the pressure roller 58 by blowing cooling air towards the pressure roller 58. The pressure roller 58 is cooled by the fan 200 to suppress scratching of the outer peripheral surface of the pressure roller 58 occurring when the separating claw 206 contacts the outer peripheral surface of the pressure roller 58 due to thermal expansion of the pressure roller 58. When the outer peripheral surface of the pressure roller 58 is scratched, a defect may occur in an image on a surface of recording paper P that contacts the pressure roller 58 during duplex printing. In addition, the pressure roller 58 is cooled by the fan 200 to, even when the outer peripheral surface of the pressure roller 58 is scratched, reduce the frequency with which a defect occurs in an image on the surface of the recording paper P that contacts the pressure roller 58 during duplex printing as the temperature of the outer peripheral surface of the pressure roller 58 is increased.

A cleaning roller 158, serving as an exemplary removing roller, that cleans the outer peripheral surface of the pressure roller 58 is disposed upstream of the nip N and downstream of the fan 200 (entrance side of the nip N) in the direction of rotation of the pressure roller 58. The cleaning roller 158 contacts the pressure roller 58, and is driven and rotated by the rotation of the pressure roller 58. The cleaning roller 158 is formed of a metallic material such as aluminum or stainless steel. The surface energy of an outer peripheral surface of the cleaning roller 158 is higher than the surface energy of the outer peripheral surface of the pressure roller 58.

A cleaning web 160, serving as an exemplary removing member, that cleans the outer peripheral surface of the cleaning roller 158 is disposed opposite a side of the cleaning roller 158 that contacts the pressure roller 58. Similarly to the cleaning web 150, the cleaning web 160 is a long strip-like fiber member (such as a polyester member, a rayon member, or a nylon member). A large portion of the cleaning web 160 is previously wound upon a rotatable shaft section 162. The cleaning web 160 is wound upon an intermediate roller 164 that is disposed close to the cleaning roller 158, and its end is secured to a shaft section 166. By rotationally driving the shaft section 166 by a motor (not shown), the cleaning web 160 is wound upon the shaft section 166 using the intermediate roller 164. That is, the cleaning web 160 cleans the outer peripheral surface of the cleaning roller 158 by contacting the outer peripheral surface of the cleaning roller 158 while the cleaning web 160 moves.

The cleaning web 150, disposed at the supporting roller 55, the cleaning roller 158, provided at the pressure roller 58, and the cleaning web 160, disposed at the cleaning roller 158, are provided for wiping off (removing) wax. That is, when toner is fused at the nip N, wax in the toner is also fused, and adheres to the outer peripheral surface of the fixing belt 56. First, when the outer peripheral surface of the fixing belt 56 contacts the outer peripheral surface of the supporting roller 55, a large portion (approximately 80%) of the fused wax adhered to the outer peripheral surface of the fixing belt 56 moves to the outer peripheral surface of the supporting roller 55. Here, the cleaning web 150 disposed at the supporting roller 55 is used to wipe off the fused wax moved to the outer peripheral surface of the supporting roller 55.

Approximately 20% of the fused wax that is not transferred to the supporting roller 55 remains on the fixing belt 56. If the fixing belt 56 and the pressure roller 58 contact each other when recording paper P does not exist at the nip N, approximately half of the fused wax remaining on the fixing belt 56 is transferred to the outer peripheral surface of the pressure roller 58. The fused wax transferred to the outer peripheral surface of the pressure roller 58 is cooled and solidified by the fan 200. Since the solidified wax on the outer peripheral surface of the pressure roller 58 is not easily uniformly spread at the nip N, the wax irregularly adheres to a surface of an image that contacts the pressure roller 58 during duplex printing. When the wax irregularly adheres to the surface of the image that contacts the pressure roller 58 during the duplex printing, a gloss difference occurs at the surface of the image. This deteriorates image quality. Therefore, the cleaning roller 158 is caused to contact the pressure roller 58, so that the wax that is solidified on the outer peripheral surface of the pressure roller 58 adheres to the cleaning roller 158, to wipe off the wax adhered to the cleaning roller 158 by the cleaning web 160.

If the fused wax transferred to the outer peripheral surface of the pressure roller 58 remains in a fused state without being cooled by, for example, the fan 200, the fused wax is uniformly spread at the nip N. Therefore, the wax uniformly adheres to the surface of the image that contacts the pressure roller 58 during the duplex printing. Consequently, a gloss difference does not occur at the surface of the image, as a result of which deterioration in image quality does not occur.

Figure 4:
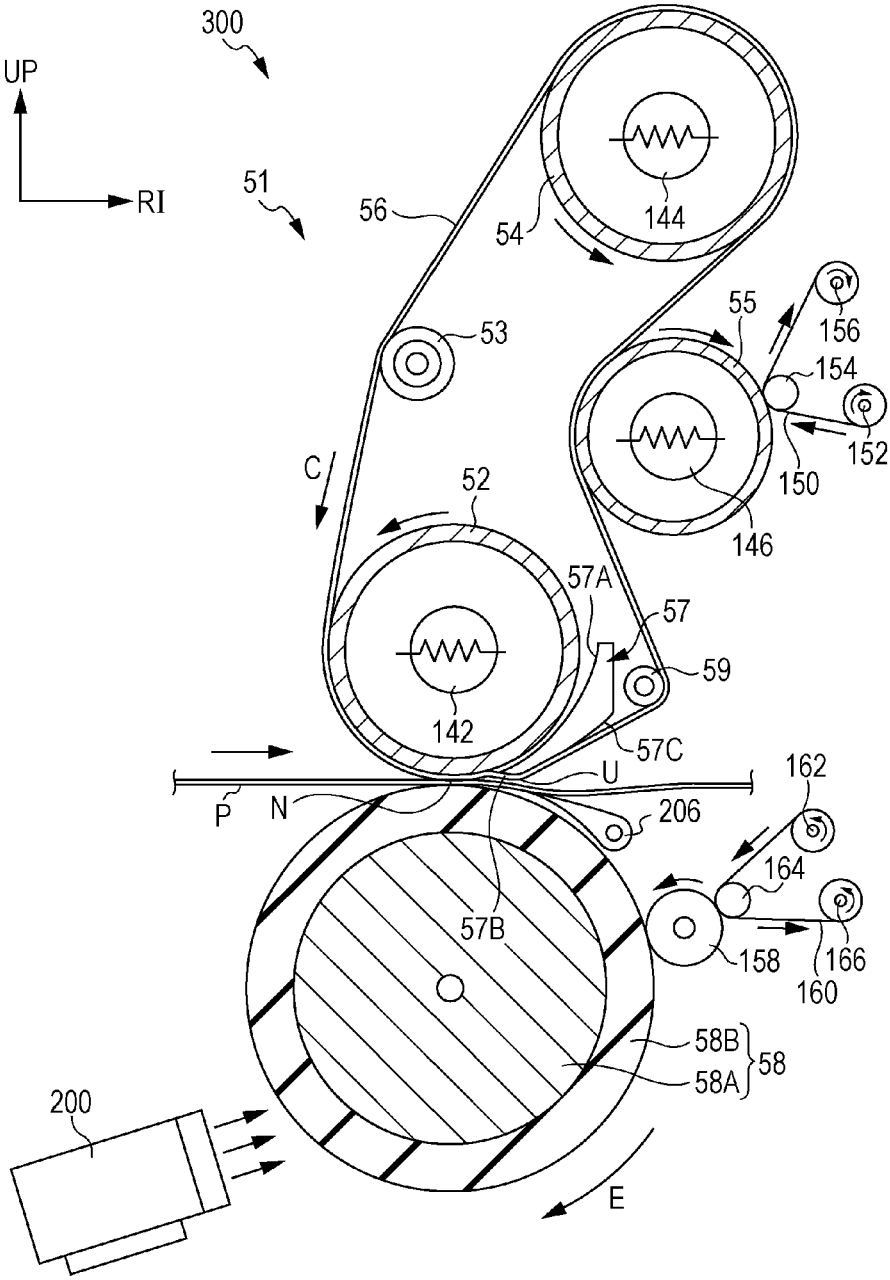
FIG. 4 illustrates a structure of a fixing section serving as a modification of a fixing section shown in FIG. 3.

FIG. 4 illustrates a structure of a fixing section 300 serving as a modification of the fixing section 50 shown in FIG. 3. In the fixing section 300, the cleaning roller 158 and the cleaning web 160 are disposed downstream of the nip N and upstream of the fan 200 (exit side of the nip N) in the direction of rotation of the pressure roller 58. In the fixing section 300, fused wax adheres to the cleaning roller 158. The wax adhered to the cleaning roller 158 is wiped off by the cleaning web 160.

Figure 5:
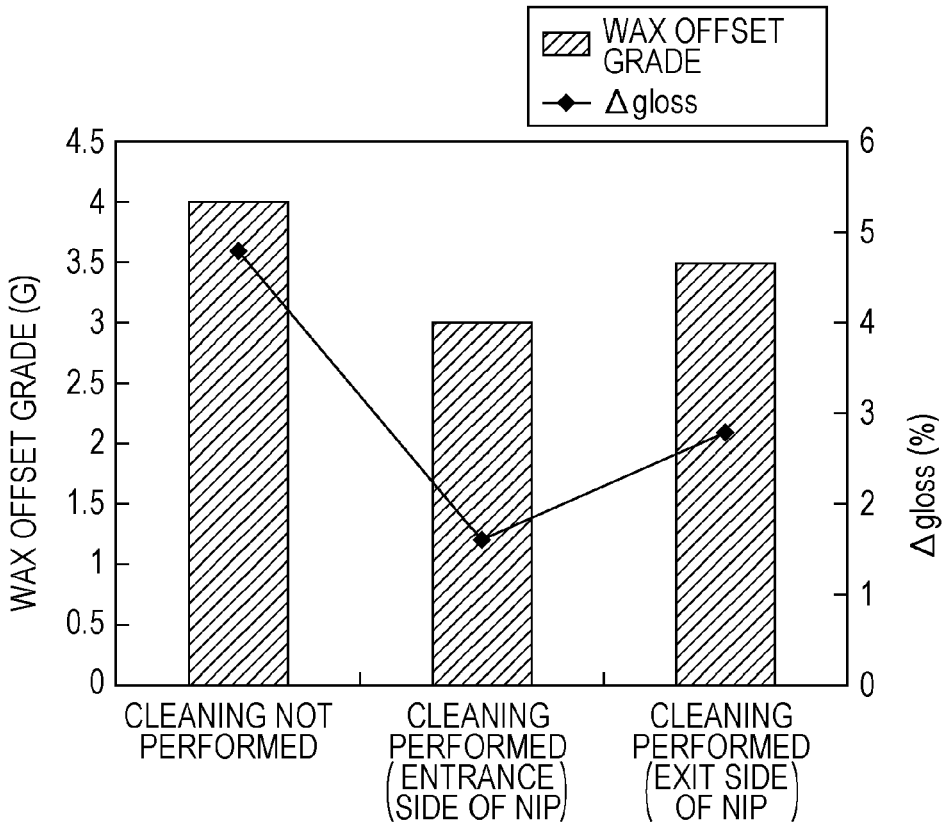
FIG. 5 is a graph showing a gloss difference when an outer peripheral surface of a pressure roller shown in FIG. 3 is not cleaned, a gloss difference when the outer peripheral surface of the pressure roller is cleaned by a cleaning roller at an entrance of a nip, and a gloss difference when the outer peripheral surface of the pressure roller is cleaned by a cleaning roller at an exit side of the nip, the gloss differences occurring at surfaces of images that contact the pressure roller during duplex printing.

FIG. 5 is a graph showing a gloss difference when the outer peripheral surface of the pressure roller 58 is not cleaned, a gloss difference when the outer peripheral surface of the pressure roller 58 is cleaned by the cleaning roller 158 at the entrance side of the nip N as in the fixing section 50, and a gloss difference when the outer peripheral surface of the pressure roller 58 is cleaned by the cleaning roller 158 at the exit side of the nip N as in the fixing section 300, the gloss differences occurring at surfaces of images that contact the pressure roller 58 during duplex printing.

A wax offset grade (G) in FIG. 5 corresponds to gloss differences converted into numerical values obtained by visual comparison with a prescribed template, the gloss differences occurring at surfaces of images. The higher the numerical value, the larger the gloss difference. Δgloss (%) in FIG. 5 is obtained by measuring the gloss differences at the surfaces of the images using a gloss meter (a product of BYK Additives & Instruments: micro TRI gloss measuring device). The higher the numerical value, the larger the gloss difference. Evaluations of the gloss differences are performed on surfaces of images that contact the pressure roller during duplex printing on 50 pieces of recording paper P performed by printing solid images on both surfaces of the 50 pieces of recording paper P at the image forming apparatus 10.

As shown in FIG. 5, the gloss difference at the surfaces of the images is large when the outer peripheral surface of the pressure roller 58 is not cleaned, and is small when the outer peripheral surface of the pressure roller 58 is cleaned. The gloss difference at the surfaces of the images is increased when the outer peripheral surface of the pressure roller 58 is not cleaned because wax solidified at the outer peripheral surface of the pressure roller 58 is not uniformly spread at the nip N, as a result of which the wax irregularly adheres to the surfaces of the images that contact the pressure roller 58 during the duplex printing. In contrast, the gloss difference at the surfaces of the images is reduced when the outer peripheral surface of the pressure roller 58 is cleaned because the solidified wax itself that causes the gloss difference is removed.

When the cleaning roller 158 is disposed at the pressure roller 58 and the solidified wax is removed from the outer peripheral surface of the pressure roller 58, the gloss difference that deteriorates image quality is reduced.

As shown in FIG. 5, the gloss difference at the surfaces of the images is small when the outer peripheral surface of the heating roller 58 is cleaned at the entrance side of the nip N than at the exist side of the nip N. This is because the wax removal performance of the cleaning roller 158 is higher when the wax at the pressure roller 58 is in a solidified state than when the wax at the pressure roller 58 is in a fused state.

Therefore, as in the fixing section 50, when the cleaning roller 158 is provided upstream of the nip N and downstream of the fan 200 (entrance side of the nip N) in the direction of rotation of the pressure roller 58, the wax removal performance is increased, so that the gloss difference that deteriorates image quality is further reduced.

The performance of removing wax from the pressure roller 58 by the cleaning roller 158 is maintained by removing wax adhered to the cleaning roller 158 by the cleaning web 160 disposed at the cleaning roller 158.

Figure 6:
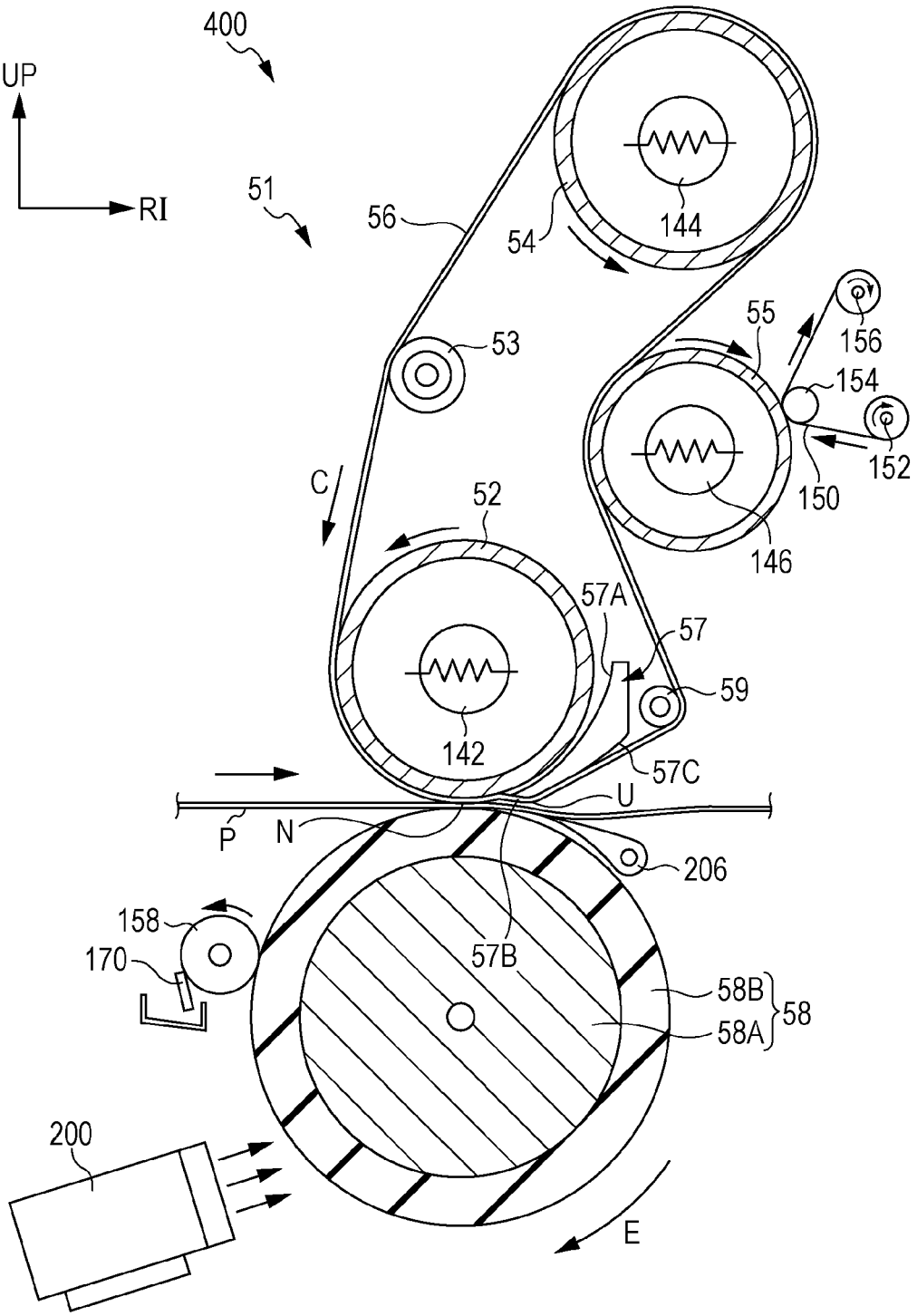
FIG. 6 illustrates a structure of a fixing section serving as a modification of the fixing section shown in FIG. 3.

FIG. 6 illustrates a fixing section 400 serving as a modification of the fixing section 50 shown in FIG. 3. In the fixing section 400, a cleaning blade 170, serving as an exemplary removing member, is disposed at the cleaning roller 158 in place of the cleaning web 160.

The cleaning blade 170 is formed of an elastic member formed of, for example, a rubber material. By contacting an end of the cleaning blade 170 with the outer peripheral surface of the cleaning roller 158, solidified wax adhered to the outer peripheral surface of the cleaning roller 158 is scraped off. The rate of removal of the wax from the cleaning roller 158 is higher for the cleaning web 160 than for the cleaning blade 170.

Therefore, it is easier to maintain the performance of removing wax from the pressure roller 58 by the cleaning roller 158 in the fixing section 50 (in which the cleaning web 160 is disposed at the cleaning roller 158) than in the fixing section 400 (in which the cleaning blade 170 is disposed at the cleaning roller 158). Therefore, the gloss difference at a surface of an image that contacts the pressure roller 58 during duplex printing is smaller for the fixing section 50 than for the fixing section 400, so that deterioration in image quality is suppressed to a greater degree in the fixing section 50 than in the fixing section 400.

Figure 7:
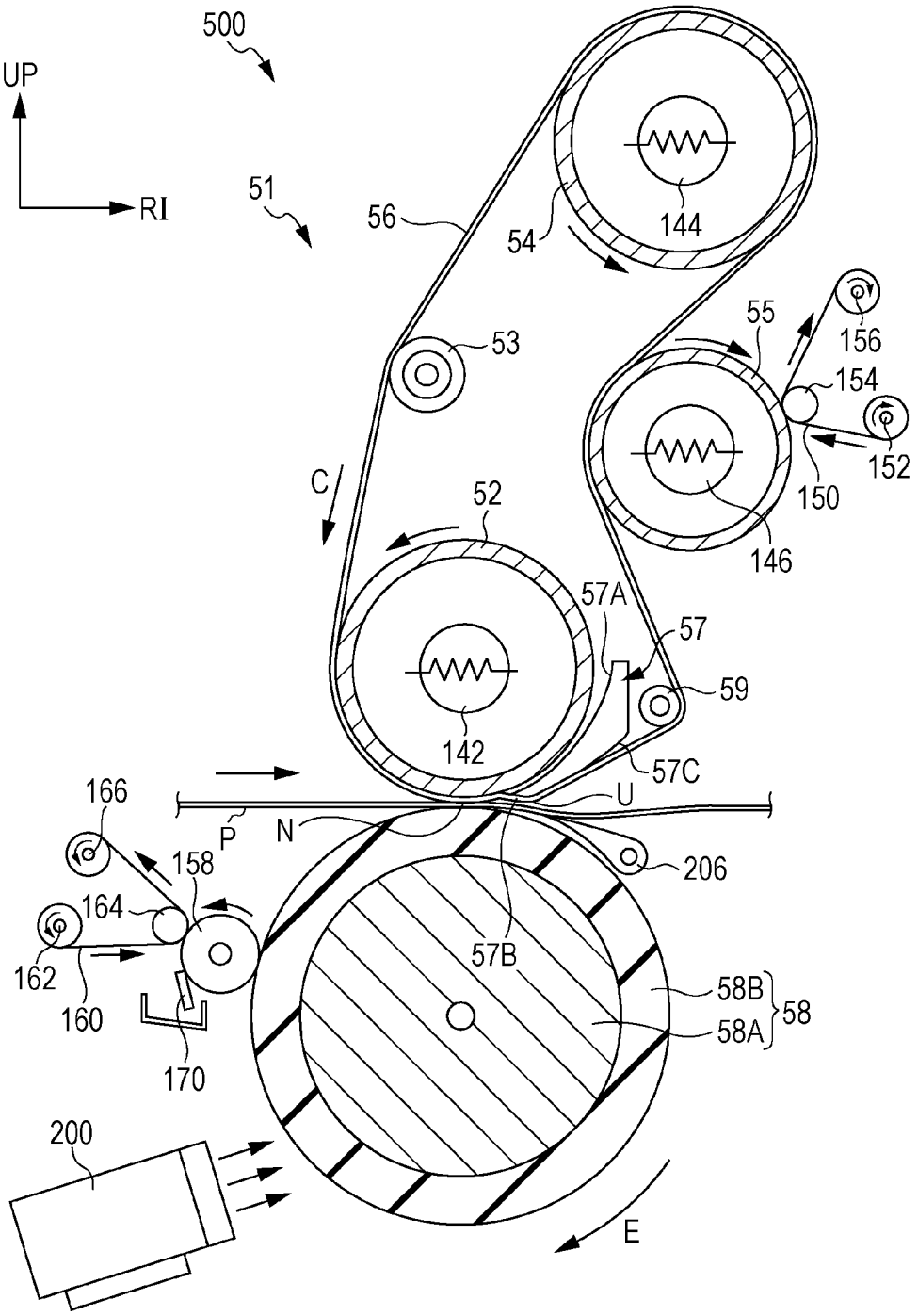
FIG. 7 illustrates a structure of a fixing section serving as a modification of the fixing section shown in FIG. 3.

FIG. 7 illustrates a fixing section 500 serving as a modification of the fixing section 50 shown in FIG. 3. In the fixing section 500, a cleaning blade 170 is disposed at the cleaning roller 158 in addition to the cleaning web 160. The rate of removal of wax from the cleaning roller 158 is higher when the cleaning blade 170 is used along with the cleaning web 160 than when the cleaning web 160 is only used.

Therefore, it is easier to maintain the performance of removing wax from the pressure roller 58 by the cleaning roller 158 for the fixing section 500 (in which the cleaning blade 170 is disposed at the cleaning roller 158 in addition to the cleaning web 160) than for the fixing section 50 (in which only the cleaning web 160 is disposed at the cleaning roller 158). Therefore, the gloss difference at a surface of an image that contacts the pressure roller 58 during duplex printing is smaller for the fixing section 500 than for the fixing section 50, so that deterioration in image quality is suppressed to a greater degree in the fixing section 500 than in the fixing section 50.

Accordingly, the fixing section 50 according to the exemplary embodiment of the present invention includes the rotatable pressure roller 58, the heating module 51, the fixing belt 56, the fan 200, the cleaning roller 158, and the cleaning web 160. The heating module 51 is provided so as to oppose the pressure roller 58, and includes the halogen heaters 142, 144, and 146. The fixing belt 56 is contacted by the heating module 51, and fixes an image, formed of toner including wax, to recording paper P as a result of transporting the recording paper P while the recording paper P is nipped at the nip N when the fixing belt 56 is pressed by the pressure roller 58, the nip being formed between the fixing belt 56 and the pressure roller 58. The fan 200 cools the pressure roller 58 at a location situated downstream of the nip N. The cleaning roller 158 removes from the pressure roller 58 wax transferred from the fixing belt 56 while the cleaning roller 158 is driven and rotated by the pressure roller 58. The cleaning web 160 contacts the cleaning roller 158, and removes from the cleaning roller 158 wax adhered to the cleaning roller 158. That is, the fixing section 50 includes the fan 200 that cools the pressure roller 58. Therefore, fused wax transferred from the fixing belt 56 is solidified at the pressure roller 58. The wax transferred from the fixing belt 56 is removed from the pressure roller 58 by the cleaning roller 158. In addition, the cleaning roller 160 is disposed at the cleaning roller 158 to remove wax adhered to the cleaning roller 158 from the cleaning roller 158, so that the performance of removing wax from the pressure roller 58 by the cleaning roller 158 is maintained. This suppresses deterioration in image quality caused by the solidified wax on the pressure roller 58.

The wax on the pressure roller 58 transferred from the fixing belt 58 is removed by the cleaning web 160 using the cleaning roller 158 that is driven and rotated by the pressure roller 58. Therefore, compared to the structure in which the wax is removed by directly contact the cleaning web 160 with the pressure roller 58, scratching of the pressure roller 58 is suppressed over a long period of time of use.

The cleaning roller 158 is provided upstream of the nip N and downstream of the fan 200 in the direction of rotation of the pressure roller 58. Therefore, wax is removed in a solidified state, so that the wax is efficiently removed from the pressure roller 58.

The cleaning web 160 is formed of a fiber member that contacts the cleaning roller 158 while the cleaning web 160 rotates. Therefore, wax is efficiently removed from the cleaning roller 158.

The image forming apparatus according to the embodiment of the present invention includes the photoconductors 36 that form electrostatic latent images, the developing devices 42 that develop the electrostatic latent images formed on the photoconductors 36 with toner including wax, the transfer section 100 that transfers the toner images developed by the developing devices 42 to recording paper P, and the fixing section 50 that fixes the toner images transferred to the recording paper P to the recording paper P. Therefore, it is possible to form an image having excellent image quality on the recording paper P.

As a removing unit/member or removing units/members that remove wax from the cleaning roller 158, the cleaning web 160 is used in each of the fixing sections 50 and 300, the cleaning blade 170 is used in the fixing section 400, and the cleaning web 160 and the cleaning blade 170 are used in the fixing section 500. However, as long as the removing unit/member or removing units/members are capable of removing wax from the outer peripheral surface of the cleaning roller 158, any removing unit/member or removing units/members may be used. For example, a cleaning brush may be used.

Although the cleaning web 150 is disposed at the outer peripheral surface of the supporting roller 55, it is possible to contact the cleaning web 150 with the fixing belt 56 and directly wipe off the wax adhered to the fixing belt 56 from the fixing belt 56.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable pressure member;

a heating member that is provided so as to oppose the pressure member, the heating member including a heat source;

a fixing member that is contacted by the heating member, the fixing member fixing an image to a recording medium as a result of transporting the recording medium while the recording medium is nipped at a nip when the fixing member is pressed by the pressure member, the image being formed of toner including a separating agent, the nip being formed between the fixing member and the pressure member;

a cooling unit that cools the pressure member;

a removing roller that, while being driven and rotated by the pressure member, removes the separating agent from the pressure member, the separating agent being transferred from the fixing member; and a removing member that contacts the removing roller and removes the separating agent adhered to the removing roller from the removing roller, wherein the cooling unit cools the pressure member at a location that is different from where the removing roller contacts the pressure member, wherein the removing roller is provided upstream of the nip in a direction of rotation of the pressure member and downstream of the cooling unit in the direction of rotation of the pressure member.

2. The fixing device according to claim 1, wherein the removing member is formed of a fiber member that contacts the removing roller while the removing member moves.

3. An image forming apparatus comprising:

an image holding member on which an electrostatic latent image is formed;

a developing device that develops with toner including a separating agent the electrostatic latent image formed on the image holding member;

a transfer device that transfers a toner image developed by the developing device to a recording medium; and the fixing device according to claim 2 that fixes the toner image transferred to the recording medium to the recording medium.

4. An image forming apparatus comprising:

an image holding member on which an electrostatic latent image is formed;

a developing device that develops with toner including a separating agent the electrostatic latent image formed on the image holding member;

a transfer device that transfers a toner image developed by the developing device to a recording medium; and the fixing device according to claim 1 that fixes the toner image transferred to the recording medium to the recording medium.

5. The fixing device according to claim 1, wherein the cooling unit cools the pressure member by directly impinging the pressure member surface with cooling air.

* * * * *